US006802325B1

(12) United States Patent
Apple

(10) Patent No.: US 6,802,325 B1
(45) Date of Patent: Oct. 12, 2004

(54) CLOSEABLE THATCHED UMBRELLA

(75) Inventor: Phillip Apple, Mt. Pleasant Mills, PA (US)

(73) Assignee: American Holtzkraft, Inc., Mt. Pleasant Mills, PA (US)

( * ) Notice: Subject to any disclaimer, the term of this patent is extended or adjusted under 35 U.S.C. 154(b) by 0 days.

(21) Appl. No.: 09/541,647

(22) Filed: Apr. 3, 2000

(51) Int. Cl.[7] ..... A45B 25/18
(52) U.S. Cl. ..... 135/33.2; 135/98; 135/16
(58) Field of Search ..... 135/98, 99, 115, 135/33.2, 15.1, 901, 16, 33.6, 907; 43/1

(56) References Cited

U.S. PATENT DOCUMENTS

| | | | | | |
|---|---|---|---|---|---|
| 2,616,571 | A | * | 11/1952 | Griffin | 135/99 X |
| 3,626,958 | A | * | 12/1971 | Ross | 135/98 |
| 3,886,678 | A | * | 6/1975 | Caccamo | 43/1 |
| 4,441,518 | A | * | 4/1984 | Hogan et al. | 135/98 |
| 4,583,344 | A | * | 4/1986 | Butler | 52/750 |
| 4,607,653 | A | * | 8/1986 | Hermanson | 135/15.1 |
| 5,020,557 | A | * | 6/1991 | Apple | 135/15.1 |
| 5,345,960 | A | * | 9/1994 | Tung | 135/32 |
| 5,901,722 | A | * | 5/1999 | Lee | 135/33.2 X |
| 6,226,949 | B1 | * | 5/2001 | Huber | 52/555 |

OTHER PUBLICATIONS

"Mexican Rain Cape panels and Umprella capes", a brochure on Web site, Safari Thatch & Bamboo, Inc. 2000.*

"The TikiTrader's Tiki Shade", pp. 1–2 and 8–9, a brochure on Web site, TikiTrader Inc., 1997–1999, 2000.*

"Palapa kit", a brochure on Web Site, Papala Kings, Inc., 3 pages.*

"Umbrella Thath Cover", a brochure on Web Site, Bamboo Hawaii, 1999, 3 pages.*

"Roof demonstration Panel", a brochure on Web Site, Royal Thatch. 3 gages.*

* cited by examiner

*Primary Examiner*—Winnie Yip
(74) *Attorney, Agent, or Firm*—Mark C. Jacobs

(57) ABSTRACT

An openable and closeable umbrella having the appearance of a thatched South Sea Island or Caribbean umbrella, and the ability to shield the users of the umbrella from the sun. The umbrella features a circular one piece woven thatch overlaid upon a fabric umbrella canopy, which canopy is conventionally attached to the frame of the umbrella. The frame includes a series of spaced ribs attached to struts and a means to open and close the frame. The woven thatch is screwed or otherwise secured to the ribs of the frame through the canopy layer. Means are provided for raising and lowering the umbrella.

9 Claims, 3 Drawing Sheets

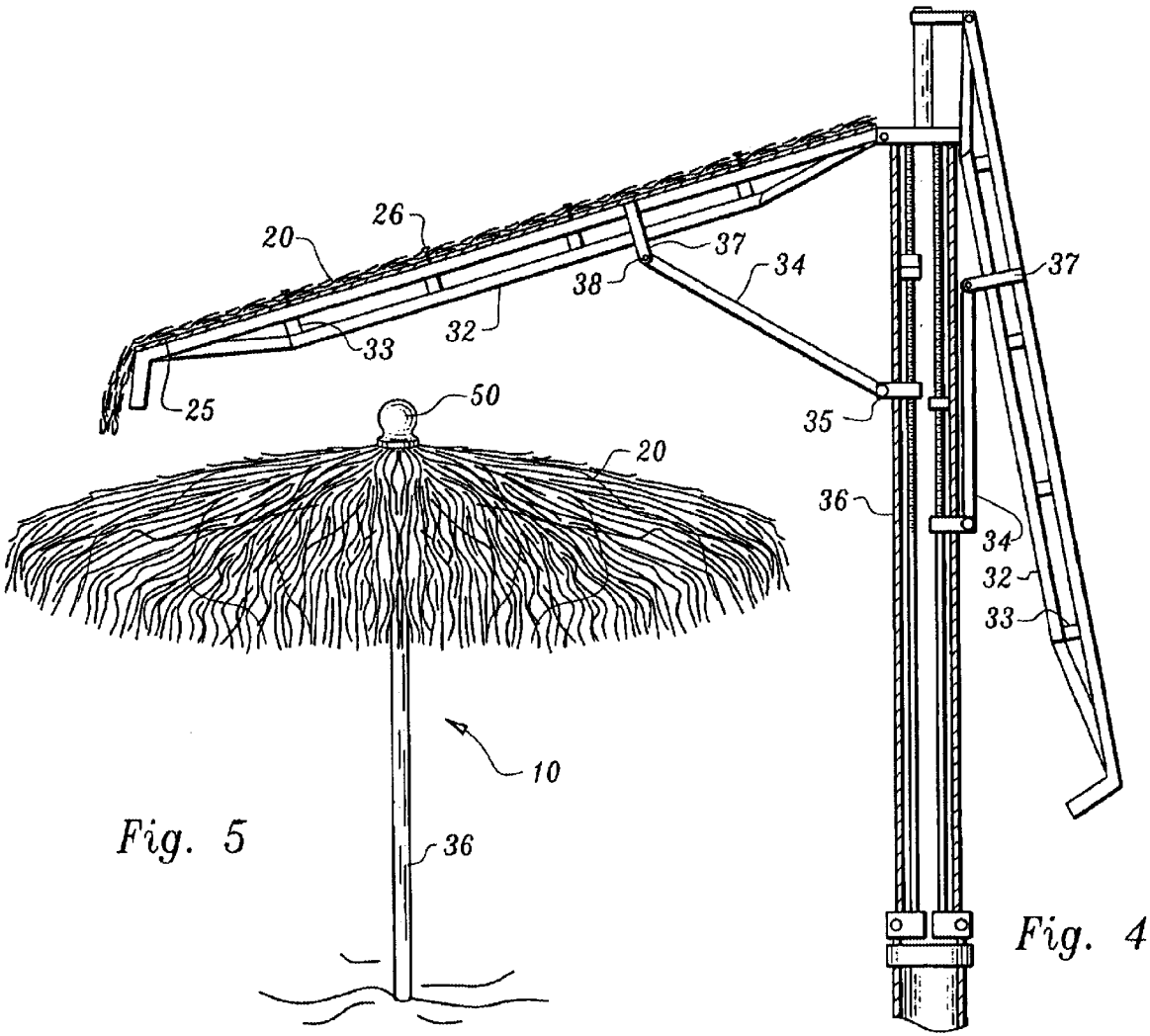
Fig. 4
Fig. 5
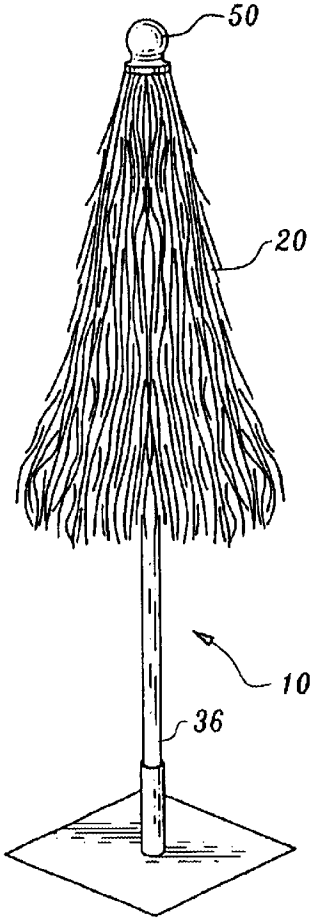
Fig. 6

CLOSEABLE THATCHED UMBRELLA

FIELD OF THE INVENTION

This invention pertains to an umbrella that opens and closes, and has the authentic appearance of a Pacific Island or Carribean thatch umbrella, yet it protects you from the rain.

BACKGROUND OF THE INVENTION

Many tourists from the west coast of the United States spend their holidays in Hawaii or in other south sea islands such as Tonga or Fiji. People from the east coast spend their warm climate holidays in the islands of the Carribean Sea. In all of these locations, one will note thatch umbrellas dotting the landscape. Such thatched umbrellas may be woven from such materials as banana leaves, palm leaves, sugar cane and other indigenous materials.

It is also known that in the tropical areas, thatching is used as a mode of building construction. Thatched roofs normally, however, are 6 to 12 inches thick, in order to try to keep out the tropical rains. Sometimes they succeed and sometimes they do not.

On the other hand, it is well known that the thatched umbrellas, serve only to protect one from the tropical sun and not from the tropical rain. That is because the thatching of the umbrellas is normally only 1 to 3 inches thick. In essence they "leak like a sieve".

American homeowners, and especially those in the warmer climates of California, Arizona, New Mexico and Florida love the appearance of thatched umbrellas, but the practical side, which dictates a need for protection from the rain as well as protection from the sun, comes into play.

Therefore it is one object of this invention to provide an umbrella that has the appearance of a South Seas thatched umbrella.

It is another object of the invention to provide a tropical appearing thatched umbrella that protects persons beneath the umbrella from the rain.

It is a third object of this invention to provide a thatched umbrella that can be opened and closed as may be desired, particularly in the case of high winds.

It is yet another object to provide a thatched umbrella that may be made in large sizes such as anywhere from 6 to 12 feet in diameter.

It is still another object to provide a thatched umbrella that can be readily stowed away during periods when nonuse is desired.

A yet further object is to provide a thatched umbrella that is readily portable and relatively light in weight.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

BRIEF DESCRIPTION OF THE FIGURES

FIG. 4 is a sectional view of the umbrella of this invention to illustrate the assembly thereof.

FIG. 5 is a perspective view of the umbrella of this invention in open position.

FIG. 6 is a perspective view of the umbrella of this invention in closed position.

SUMMARY OF THE INVENTION

A thatched umbrella having the appearance of an authentic South Sea Islands umbrella, yet possessing all the practicality of a garden umbrella in that it protects the persons beneath it from the rain. The umbrella can be opened and closed as needed for transportation, relocation, and storage.

The device of this invention comprises a layer of a continuously woven circular thatch attached to an acrylic or other water resistant fabric canopy mounted to an openable-closeable umbrella frame.

DESCRIPTION OF THE PREFERRED EMBODIMENT

Figure 1:
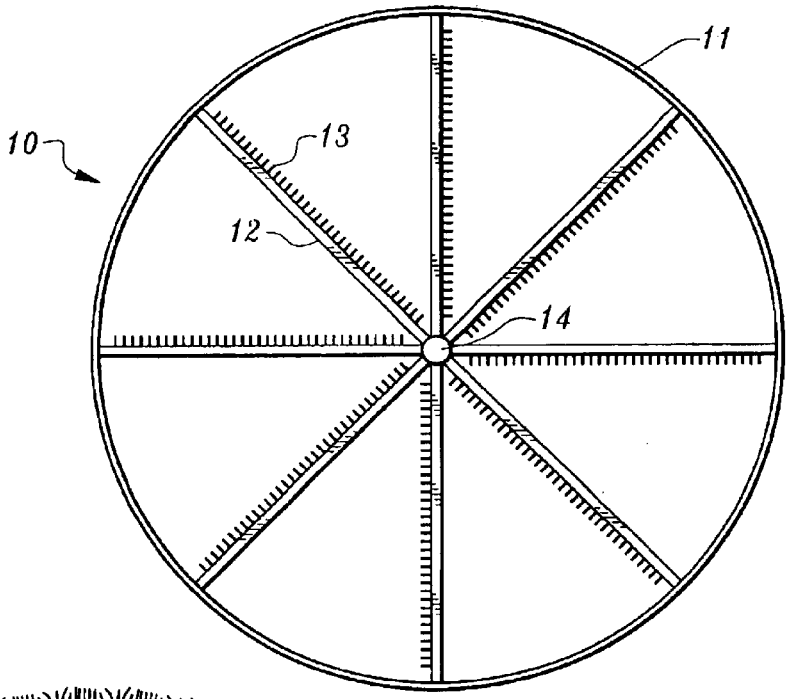
FIG. 1 is a top plan view of a jig used to make the thatch covering forming part of this invention

In FIG. 1 there is seen a circular jig which may range from about 6 to 12 feet in diameter, though larger and smaller diameters are also envisioned. The diameter of the jig will correspond to the ultimate diameter of the umbrella to be manufactured according to this invention.

Jig 10 comprises a circular hoop 11 having a plurality of spaced ribs or radii 12. Here eight are shown. The number of the radii may be larger or smaller than eight, as may be desired. Spaced preferably uniformly along the length of each of the radii is a series of guide pins, 13 which pins serve to retain to thatch material in place during the course of the weaving process. If the radii are metal stamps or extrusions, the guide pins 13 may be attached to the metal radii as by welding, brazing, gluing or any other known means of securing. The radii may also be wood struts, in which case the guide pins can be attach as by nailing, screwing, or gluing. The hoop 11 is most appropriately metal such as flexible steel or aluminum though wood or plastic construction is also contemplated.

Figure 2:
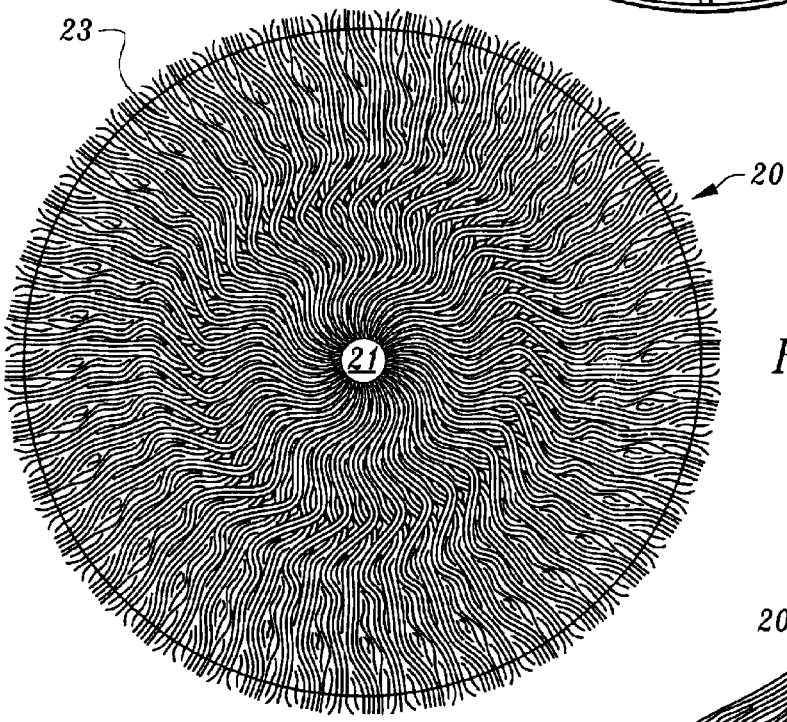
FIG. 2 is a top plan view of a continuously woven thatch annulus prepared according to this invention.

In FIG. 2, the continuously woven circular thatch is configured as a thatched annulus, 20. It is within the ready skill of a weaver, to prepare a continuous thatch circle the diameter of which would match the diameter of the jig being employed. The leaves used for the thatch may be coconut palm, banana palm, sugar cane or any other long pliable leaf that can be woven by methods handed down from generation to generation. The actual weaving technique employed is not related to this invention. The center opening 21 of the woven annulus, permits the thatch to be applied to the umbrella structure by overlaying the thatch annulus on a canopy followed by the addition of a finial.

It is also within the scope of the application to employ as the continuously woven circular thatch, a thatched disk 20-D instead of an annulus. That is, there would be no central opening. Such a disk configuration would be utilized if the construction of the umbrella were to omit a top final such as 50 shown in FIGS. 5 and 6.

Figure 3:
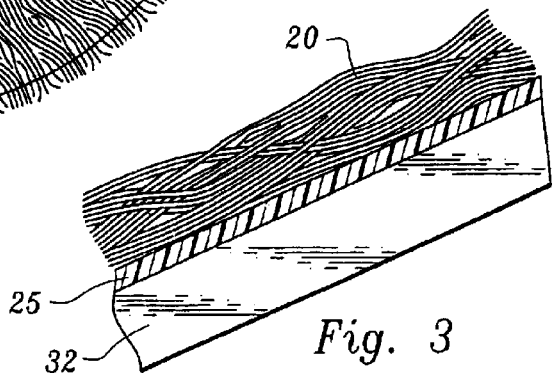
FIG. 3 is a diagrammatic view illustrating the various layers involved in this structure.
Figure 8:
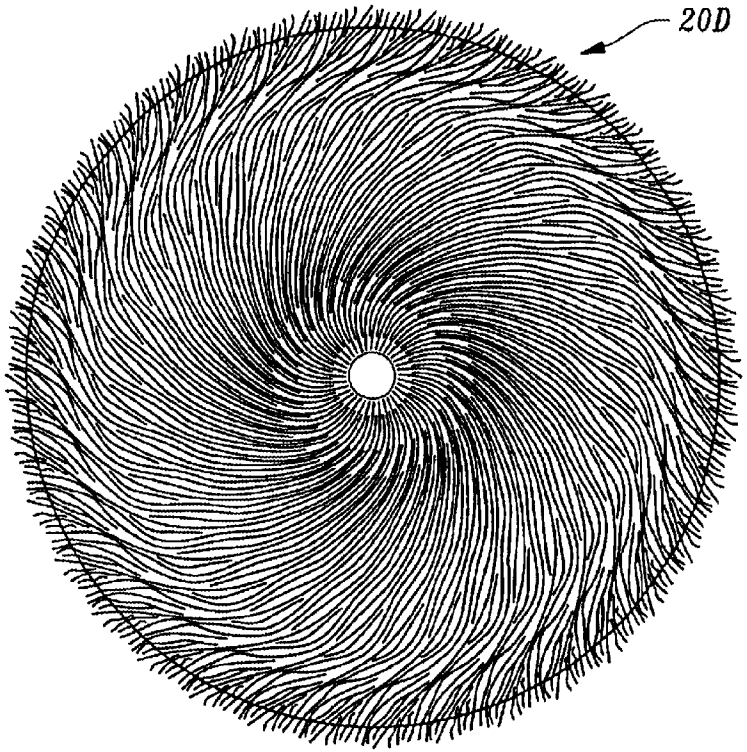
FIG. 8 is a top plan view of an alternate embodiment of the thatch overlay, wherein the woven thatch is configured as a disk.

Reference is now made to FIG. 3, which shows the layers that form the umbrella structure of this invention. In this figure, 20 represents the thatch layer as has been denoted in FIG. 2. The acrylic or other material canopy found in a umbrella is designated layer 25, while the layer 32 designates the wood or metal rib of the umbrella to which the thatch is attached with the canopy layer being interposed there between. For reference, it is seen that the canopy has an exterior surface and an interior surface. The interior surface overlays the umbrella frame, and the exterior surface of the canopy interfaces the woven thatch.

FIG. 4 is related to FIG. 3 in that shows the relative disposition of the various layers that form the construction of the umbrella. Here the thatch 20 is seen to be overlaid upon the canopy layer 25. Suitable canopy materials include the previously noted acrylic, as well as polyester, nylon, cotton and canvas. Woven acrylic fabric of about 9.5 oz is the preferred canopy material.

In the umbrella construction illustrated, the series of spaced ribs 32, are seen to have an optional small reinforcing. gusset 33 spaced at various locations along the length thereof for added strength.

To permit the opening and closing of the umbrella, each rib 32 includes a small rib arm 37 disposed normal to the length of the rib. Each rib arm, at one end, includes a suitable aperture for connection of a strut 34 by pin 38 which passes through an unseen aperture in said strut to connect the strut to the rib arm, 37. The rib arm at its opposite end is connected in conventional fashion to hub 35. Hub 35 is disposed in conventional fashion on pole 36.

Figure 7:
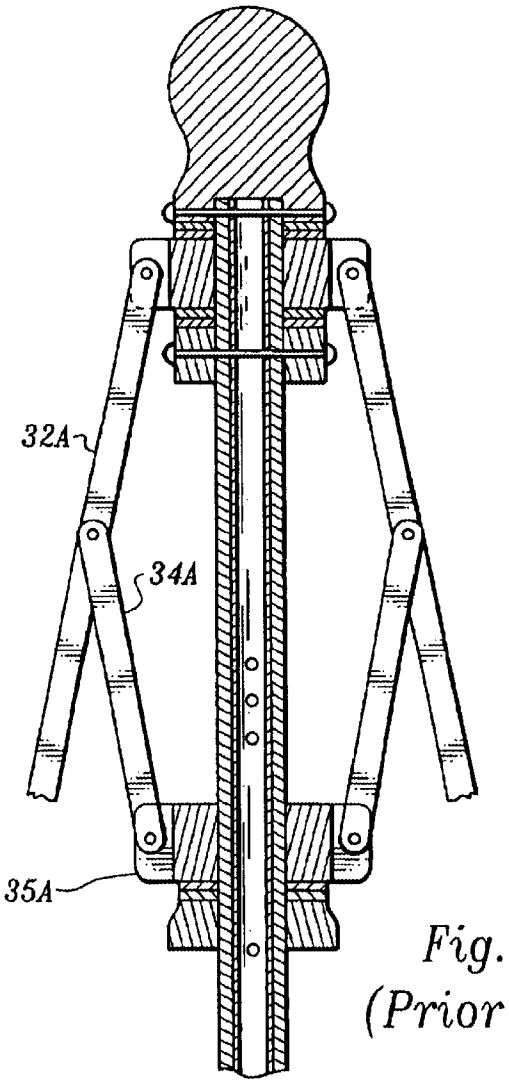
Fig. 7 (Prior Art)
FIG. 7 is a detailed sectional view of an alternative typical umbrella mode of construction that can be employed with this invention.

The reader's attention is turned now to FIG. 7, which is a partial recreation of FIG. 3 of applicant's U.S. Pat. No. 5,020,557 issued Jun. 4, 1991. This now prior art patent illustrates yet another means of connecting a strut 34A to the rib 32A, which strut is connected to hub 35A. The disclosure of the Apple U.S. Pat. No. 5,020,557 is incorporated herein by reference to help emphasize the point that there is no criticality to the construction employed for the struts, ribs, hub and pole of the invention of this application.

Returning to FIG. 4, it is seen that the thatch is applied through the canopy layer to each of the spaced ribs, by utilizing a series of screws 26 for example, as is shown in the figure. If the ribs are wood, then common wood screws, preferably of a galvanized or stainless steel material should be employed. If the ribs are of metal, then self-tapping screws commonly used in the metal arts also preferably of stainless steel, brass or galvanized material should be employed.

When the thatch annulus is overlaid on the canopy, the central opening is fitted over the pole. This helps to align the thatch to the canopy. Once the thatch is secured as discussed infra, the finial is attached on the top of the pole by any means known to the art.

As to the opening and closing aspect of the umbrella, any conventional opening and closing mechanism, such as the one disclosed in the aforementioned Apple patent may be employed to open and close the umbrella of this invention upon demand of the user. The opening and closing mechanism is disposed upon the pole of the umbrella.

In conclusion it is seen that by employing a continuous one piece thatch annulus, and overlaying it upon a rain retarding canopy attached to an umbrella frame, securing the thatch to the umbrella frame, with the annular opening fitting over the pole, and then adding a finial to the top of the pole, I have provided what appears to be a South Seas thatched umbrella, with all of the practicality associated with a rain retarding garden umbrella, that lessens the amount of rain to impact persons therebeneath.

Since certain changes may be made in the described device without departing from the scope of the invention herein involved, it is intended that all matter contained in the above description and shown in the accompanying drawings shall be interpreted as illustrative and not in a limiting sense.

I claim:

1. A thatched umbrella which is openable and closeable, which umbrella comprises:

(a) a continuously woven one-piece circular thatch, prepared on a jig having a plurality of spaced radii, each of which radii has a series of uniformly spaced guide pins along the length thereof, which guide pins serve to retain the thatch material in place during the course of the circular weaving, (b) an umbrella frame having a series of ribs, each of which is interconnected to a strut, each of which struts is interconnected to a hub, said hub disposed upon a pole, (c) an umbrella canopy, having an exterior surface, overlaying and connected to said frame, said continuously woven one-piece circular thatch being disposed upon said canopy's exterior surface, and being connected to said frame's ribs through said canopy, and (d) means for opening and closing said frame disposed on said pole.

2. The device of claim 1 wherein the continuously woven one-piece circular thatch is configured as an annulus.

3. The device of claim 2 further including a finial disposed on said pole.

4. The device of claim 1 wherein the continuously woven one-piece circular thatch is configured as a disk.

5. The device of claim 1 wherein the canopy is selected from a fabric member selected from the group consisting of acrylic, polyester, nylon, cotton and canvas.

6. The device of claim 1 wherein the woven thatch is connected to the umbrella frame by a series of spaced screws.

7. The device of claim 1 further including a final disposed on said pole.

8. The thatched umbrella of claim 1 wherein the umbrella canopy is made of acrylic fabric, the circular one-piece woven thatch is configured as an annulus, and a finial is disposed on the pole.

9. A thatched umbrella which is openable and closable on demand, which umbrella comprises;

(a) a continuously woven one-piece circular thatch configured as an annulus having a central opening, (b) an umbrella frame having a series of radii, each of which is interconnected to a strut, each of which struts is interconnected to a hub, said hub disposed upon a pole, said pole having means for receiving a finial;

(c) an umbrella fabric canopy having an exterior surface and an interior surface, the interior surface overlaying said frame, and the canopy being connected to said frame, said continuously woven one piece circular thatch being disposed upon said canopy's exterior surface, with the central opening of the annulus being disposed over the means for receiving a finial;

(d) means for opening and closing said frame disposed in said pole, and (e) a finial disposed on the top of said pole's finial receiving means overlying said central annulus of said thatch.

* * * * *